US005913573A

United States Patent [19]

Schlegl et al.

[11] Patent Number: 5,913,573

[45] Date of Patent: Jun. 22, 1999

[54] ROOF BOLT DRILLING AND SETTING APPARATUS

[75] Inventors: Franz Schlegl, Semriach; Alfred Zitz, Zeltweg, both of Austria

[73] Assignee: Voest-Alpine Bergtechnik Gesellschaft m.b.H., Zeltweg, Austria

[21] Appl. No.: 08/849,295

[22] PCT Filed: Nov. 28, 1995

[86] PCT No.: PCT/AT95/00233

§ 371 Date: May 28, 1997

§ 102(e) Date: May 28, 1997

[87] PCT Pub. No.: WO96/17155

PCT Pub. Date: Jun. 6, 1996

[30] Foreign Application Priority Data

Nov. 28, 1994 [AT] Austria ..... 2204/94

[51] Int. Cl.[6] ..... E21C 35/20; E21D 20/00

[52] U.S. Cl. ..... 299/33; 299/64

[58] Field of Search ..... 299/11, 33, 64

[56] References Cited

U.S. PATENT DOCUMENTS

| | | | |
|---|---|---|---|
| 3,995,905 | 12/1976 | Jamison | 299/11 |
| 4,199,193 | 4/1980 | Damron et al. | 299/33 X |
| 4,758,049 | 7/1988 | Wernigg et al. | 299/33 |
| 4,865,390 | 9/1989 | Shrader et al. | 299/11 |

FOREIGN PATENT DOCUMENTS

| | | |
|---|---|---|
| 367 524 | 7/1982 | Austria . |
| 2 570 758 | 3/1986 | France . |
| 2 208 710 | 9/1973 | Germany . |
| 31 08 877 | 1/1982 | Germany . |
| 2 232 429 | 12/1990 | United Kingdom . |
| 92/05339 | 4/1992 | WIPO . |

*Primary Examiner*—David J. Bagnell

*Attorney, Agent, or Firm*—Pillsbury Madison & Sutro LLP

[57] ABSTRACT

A displaceable mining machine (1) comprises roof bolt drilling and setting apparatus (5, 13). A conveyor (6) is articulately pivotable in a rear portion of the machine about axes (16, 16') in order to provide space for a roof bolt drilling and setting apparatus (13) pivotable via an articulated arm (12) and operating behind the mining machine (1).

15 Claims, 5 Drawing Sheets

FIG. I

FIG. 4
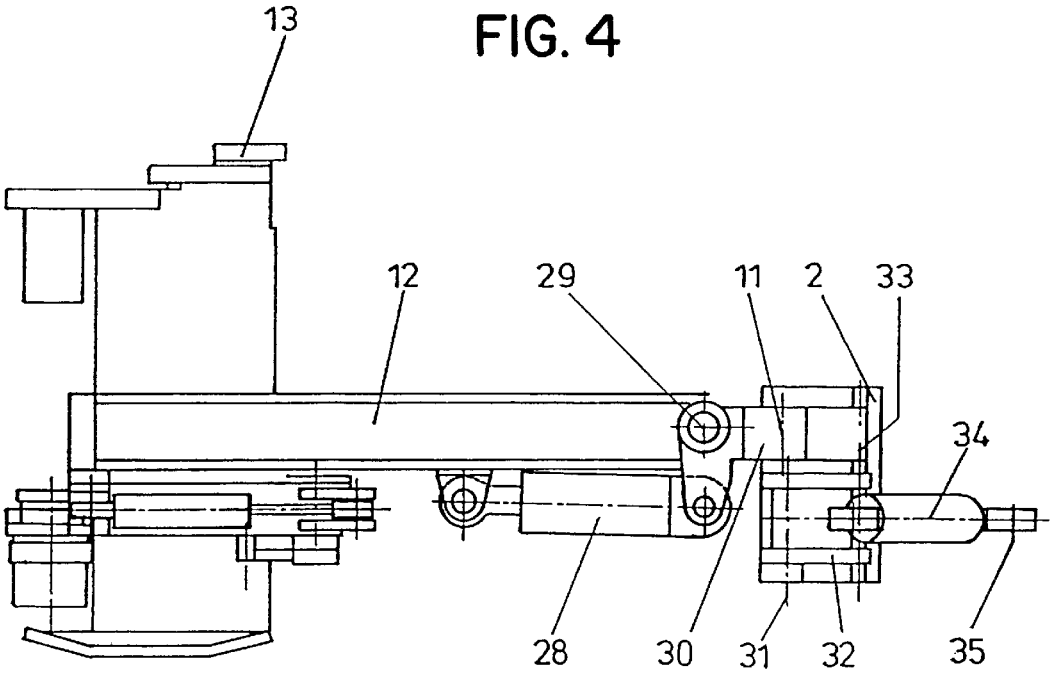
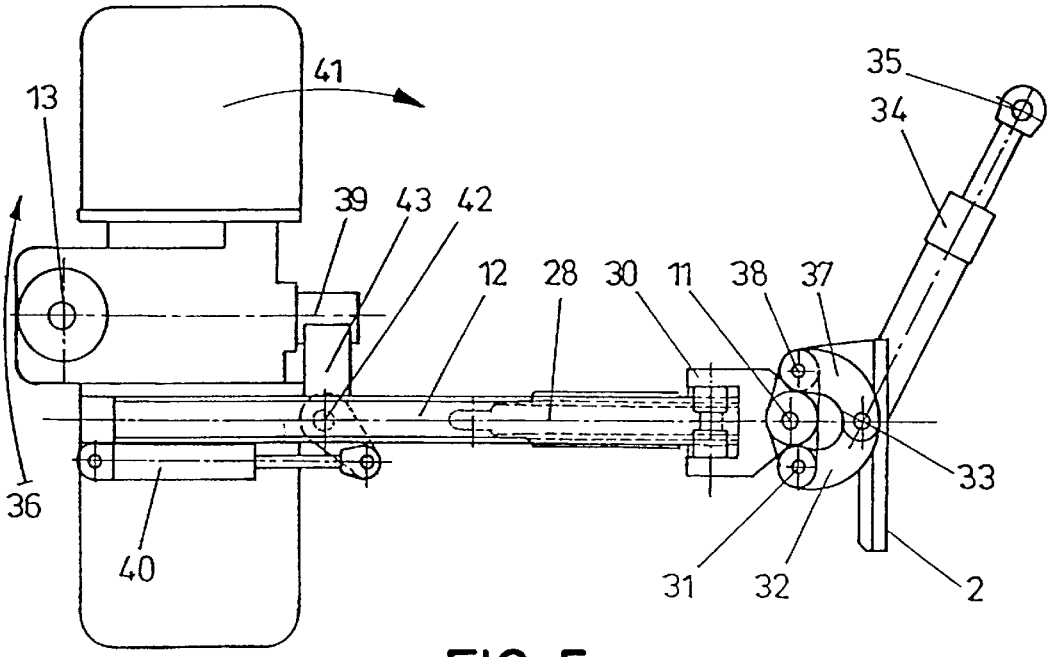
FIG. 5

ROOF BOLT DRILLING AND SETTING APPARATUS

This application is the national phase of international application PCT/AT95/00233, filed Nov. 28, 1995 which was designated the U.S.

BACKGROUND OF THE INVENTION

1. Field of the Invention

The invention relates to a roof bolt drilling and setting apparatus connected with a displaceable mining machine in a manner relatively movable thereto and capable of being positioned outside the contour of the top view on the mining machine and of being braced between roof and floor, wherein the mining machine is equipped with a conveying means including a discharging site provided behind the travelling mechanism of the mining machine.

2. Prior Art

When driving roadways, a defined roof bolt pattern is to be observed for holding up the roof. To this end, it is known to position roof bolt drilling and setting apparatus outside the contour of the top view on a mining machine or cutting machine, wherein, in particular, if creviced roofs are to be expected, such roof bolting should be realized as close to the mine face as possible in order to keep the unsupported, or unsecured, area as short as possible. Such roof bolt drilling and setting apparatus may be connected with the cutting machine or mining machine in order to thereby safeguard the desired position near the mine face at predetermined distances relative to the mine face. Apparatus of this type are described, for instance, in Austrian Patent No. 392 119, in which the roof bolt drilling and setting apparatus are articulately connected with the cutting machine and hydraulically braceable between the roof and floor of the roadway. Another form of an articulate connection of roof bolt drilling and setting apparatus with a mining machine may be taken, for instance, from DE-A1 33 34 975. In that known configuration, the roof bolt drilling and setting apparatus are laterally connected with a mining machine via articulated arms and are braceable between roof and floor. Such an apparatus allows for parallel operation to a large extent, it being sufficient to place the respective positioning mechanism for adjusting the correct positions of the roof bolt drilling and setting apparatus out of engagement in order to ensure the free movability of the articulated arm relative to the cutting machine, wherein the roof bolt drilling and setting apparatus, after having been braced between roof and floor, remain secured in their selected positions so as to afford accordingly precise bolt holes.

However, with all of those known arrangements which basically are to ensure parallel operation, it has so far been possible to set bolt holes only outside the contour of the top view on the mining machine and, in particular, laterally outside that contour if such bolt holes were to be drilled near the mine face. In particular, with mining machines or cutting machines comprising relatively wide cutting rolls, the distances between such lateral bolt holes are, however, relatively large, thus requiring additional holes to be drilled centrally for setting what is called center roof bolts in order to hold up the roof. Such center roof bolts in hitherto known arrangements can be provided only by means of separate roof bolt drilling and setting apparatus at a large distance behind the mining machine, parallel and largely automated operation immediately following the road progress being unfeasible with the known arrangements.

SUMMARY OF THE INVENTION

The invention aims at providing an apparatus of the initially defined kind, which allows for the additional setting of a center roof bolt in a precisely defined spaced relationship at a distance from the mine face as short as possible. The invention, in particular, aims at rendering such positioning near the mine face feasible even if the machine is equipped with a central conveyor. To solve this object, the roof bolt drilling and setting apparatus according to the invention, of the initially defined kind essentially consists in that the conveying means near the rear end of the mining machine is constructed so as to be pivotable about a first pivot axis extending transverse to the longitudinal axis of the machine and a second pivot axis provided at a distance behind said first pivot axis and that at least one roof bolt drilling and setting apparatus is connected with the mining machine in the rear section thereof by means of a pivot arm and is pivotable into a position in the extension of the longitudinal central axis of the mining machine. Due to the fact that the central region immediately behind the mining machine, which is partially occupied by the conveying means in conventional arrangements, may be cleared by pivoting the conveying means about a first pivot axis, the precise positioning in that cleared region of a roof bolt drilling and setting apparatus advanced together with the cutting machine or mining machine becomes feasible. By the conveying means having a second pivot axis, an articulateness is ensured, that renders conventional conveying means for further conveyance directly usable without any modification, since after a new pivotal movement substantially the original position may again be assumed by the discharging site and the double developability of the conveying means merely is to provide the space required for positioning an additional roof bolt drilling and setting apparatus in the extension of the longitudinal axis of the mining machine. In this manner, a center roof bolt can be set directly behind the mining machine and, due to the predetermined geometry, precise geometric adjustment of the hole distances relative to the roof bolt drilling and setting apparatus coupled, for instance, to the supporting system of the mining machine can be ensured. The additional roof bolt drilling and setting apparatus arranged in the rear portion of the mining machine supplements the roof bolt drilling and setting apparatus that is integral with the machine support and capable of setting the respective roof bolts immediately behind the loading means outside the central axis of the mining machine. Advantageously, the configuration according to the invention is devised such that the pivot arm of the rear roof bolt drilling and setting apparatus is designed as an articulated arm comprising two arms that are pivotable about parallel axes, such a double-articulated configuration enabling exact positioning and, at the same time, also offering the opportunity of decoupling this consecutively arranged roof bolt drilling and setting apparatus for the center roof bolt from vibrations and movements of the machine. The free space required for handling the roof bolt drilling and setting apparatus in the central zone of the road is safeguarded by the articulate configuration of the conveying means of the mining machine.

According to an advantageous further development, the configuration is such that the articulated arm for the rear roof bolt drilling and setting apparatus is dimensioned such that the longitudinal distance of the bolt holes in the longitudinal direction of the machine relative to the roof bolt drilling and setting apparatus operating near the mine face corresponds to an even-numbered multiple of the longitudinal distance of neighboring holes outside the longitudinal axis of the machine. Such a configuration enables the center roof bolts to be each arranged so as to register in the connection line between two lateral bolt holes located on the same level so that sheathing elements or roof bolts can be attached in a simple manner.

In order to ensure that the conveying means in the desired manner is able to cooperate with conventional conveying means consecutively arranged within the road, the configuration advantageously is devised such that the first and second pivot axes of the conveyor extend substantially parallel with each other. In this configuration, lifting of the conveyor in the rear portion of the machine will result in the desired stacking height on the discharging site even at angular positions of the individual sections in the rear end portion of the conveyor, wherein the configuration advantageously is devised such that the conveyor end portion carrying the first pivot axis is supported on the mining machine so as to be adjustable in height and pivotable about an axis substantially parallel with the floor in order to precisely adjust said stacking height.

The angular movability or articulateness of the conveying means which is connected with the cutting or mining machine in addition to the advantage of providing the respective free space for the setting of a center roof bolt also offers the advantage of being able to precisely adjust the discharging position onto consecutive conveying means provided in the road. Advantageously, the configuration is devised such that the conveyor part oriented towards the discharging site on the second pivot axis carries a supporting wheel that is movable in the sense of pivotability, wherein, preferably, the discharging section of the conveyor is set in pivotal movement via a travelling mechanism of the supporting wheel.

Since in the driving of a roadway either left-hand or right-hand junctions are exclusively provided, as a rule, the divided pivotable conveyor that is directly connected with the machine may be preadjusted accordingly, to which end the configuration advantageously is devised such that the pivot angle of the conveyor portion located between the two pivot axes is rigidly fixed relative to the longitudinal axis of the machine during operation. Depending on the preselected pivoted position of the first portion of the mining machine conveyor, the boom or pivot arm for the rear roof bolt drilling and setting apparatus may be hinged either to the left-hand and/or to the right-hand rear side of the machine. If two booms are provided, one roof bolt pattern including two roof boltings may be realized near the linearly conducted conveyor.

The use of supporting wheels in a particularly simple manner enables the final section of the conveying means to be designed so as to be adjustable in height, to which end it will do to connect the travelling mechanism with said final section of the conveying means of the mining machine in a height-adjustable manner.

In order to largely increase the field of application of the roof bolt drilling and setting apparatus, the pivotable arm(s) of the articulated arm advantageously is/are designed as telescopic arm(s). Due to the extendible articulated arms, also tunnel zones farther remote from the mining machine are reached, thereby obtaining an altogether higher stability exactly when using but few roof bolt drilling and setting apparatus.

Advantageously, the flexibility of use of the roof bolt drilling and setting apparatus may be enhanced in that the roof bolt drilling and setting apparatus is connected with the pivot arm so as to be pivotable into a horizontal position via a rollover. As opposed to roof bolt drilling and setting apparatus that cannot be changed in their vertical positions, the vertical pivotability into a horizontal position according to requirements offers the possibility to pass by the conveying means running towards the tunnel end by horizontal pivoting without involving any modification work. After termination of the horizontal pivoting procedure, the roof bolt drilling and setting apparatus may be placed back into its vertical position for further operation. By the roof bolt drilling and setting apparatus being tiltable into the horizontal line and pivotable through below the conveyor, also the movability of the mining machine as a whole may be enhanced in addition to the optimum choice of the operating position with a view to guaranteeing safety and stability. Thereby, a single arm centrally supported on the rear end of the mining machine in a pivotable manner is usable for any desired position.

In order to cover as large a pivot angle range as possible, the coupling site between pivot arm and rear portion of the mining machine advantageously is configured such that a revolute joint mechanism hinged to one side of the pivot arm cooperates with a cylinder piston aggregate hinged to the rear portion of the mining machine and that the pivot angle range of the pivot arm behind the mining machine amounts to approximately 180°. By arranging a revolute joint mechanism on the side of the pivot arm to cooperate with the cylinder piston aggregate, a transmission enabling the obtainment of a large pivot range is provided. By providing such a revolute joint mechanism structure, it is feasible to realize a very small-size coupling site in compact form such that already a slight shift of the cylinder piston aggregate results in a large pivot angle of the roof bolt drilling and setting apparatus.

The compactness of the roof bolt drilling and setting apparatus in the horizontal parking and pivoting positions, according to a particularly preferred embodiment is provided in that the roof bolt drilling and setting apparatus is pivotable on the rear end of the pivot arm about a vertical axis provided on the rollover. By means of a roof bolt drilling and setting apparatus mounted in a horizontally pivotable manner, this is placed in a position at a slight distance from the mining machine before being pivoted into the horizontal plane. Due to the fact that the roof bolt drilling and setting apparatus is turned towards the mining machine in a first step, enhanced lever transmissions for the subsequent step, i.e., the vertical pivoting into the horizontally pivoted position in the rear portion of the mining machine may be obtained by that weight transfer, on the one hand. On the other hand, the overall length of the mining machine is altogether reduced in the horizontally pivoted position, the unit comprised of pivot arm and tilted roof bolt drilling and setting apparatus thus becoming more compact and shorter.

According to another advantageous configuration, the roof bolt drilling and setting apparatus with the rollover assumes such a position relative to the pivot arm that the rollover in the starting position for vertical pivoting is supported on a bearing provided on the pivot arm. By the rollover being supported on a bearing of any kind, the connection to the roof bolt drilling and setting apparatus is relieved. Such a seat, in turn, ensures the enhanced absorption of the lever forces, which are rather intensified during the pivoting procedure by the dynamic portions.

In order to further improve the maneuverability of the mining machine, the pivot arm is designed such that at least one of the pivotable arms of the pivot arm is vertically pivotable via a hydraulic cylinder piston aggregate. By the pivotable arms being vertically pivotable, largely interruption-free displacement of the mining machine is safeguarded even if uneven ground comprising, for instance, depressions is to be passed. Thus, the nature of the ground can always be taken into account by acting on the vertical inclination of the pivot arm.

In a particularly simple configuration, the roof bolt drilling and setting apparatus via the pivot arm is hinged to the mining machine in a manner that the pivot arm is hinged to the mining machine laterally outside the longitudinal central plane. Roof bolt drilling and setting apparatus attached laterally in such a manner either are employed in the rear portion or are usable as additional means for setting further roof bolts, for instance, in the region of the side wall of the tunnel. Due to the lateral attachment of the pivot arms, positions laterally located very far away can be reached.

BRIEF DESCRIPTION OF THE DRAWINGS

In the following, the invention will be explained in more detail by way of exemplary embodiments schematically represented in the drawing.

Therein, FIG. 4 is a transverse view of the portion extending from the rear end of the mining machine as far as to the roof bolt drilling and setting apparatus in the operating position, FIG. 5 is a top view on the apparatus according to FIG. 4.

DETAILED DESCRIPTION OF A PREFERRED EMBODIMENT OF THE INVENTION

Figure 1:
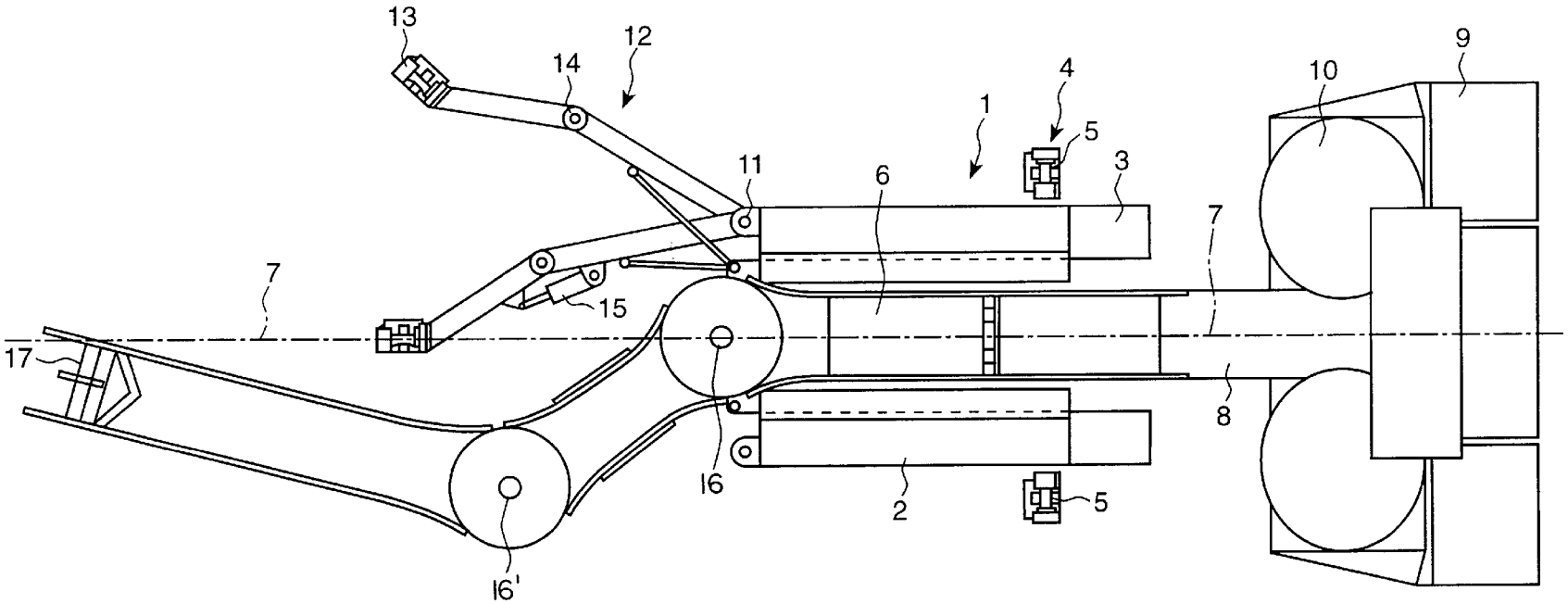
FIG. 1 is a top view on a first embodiment of the apparatus according to the invention.

A mining machine 1 is represented in FIG. 1. The machine frame 2 comprises a tracklaying truck 3. Lateral machine supports 4 comprising roof bolt drilling and setting apparatus 5 are connected with the machine frame 2. A central conveyor 6 is supported centrally on the machine frame 2 so as to be displaceable in the longitudinal direction of the machine. The longitudinal direction of the cutting machine is denoted by 7 and also the cutter arm 8 carrying a cutting tool 9 is mounted so as to be displaceable in the longitudinal direction of the cutting machine, i.e., in the direction of its central axis 7. The conveying members of the loading means are schematically indicated by 10. In the rear portion of the machine frame 2, an articulated arm 12 is pivotably hinged about an axis 11 and comprises a further roof bolt drilling and setting apparatus 13 on its free end. The articulated arm 12 is pivotable about a pivot axis 14 extending parallel to the first pivot axis 11 and a pivoting mechanism 15 is provided for moving the roof bolt drilling and setting apparatus 13 into the extended longitudinal axis 7 of the mining machine. In order to clear the space required therefor, the conveyor 6 is designed to be angled, and there is provided a first pivot axis 16 as well as a second pivot axis 16' substantially parallel with the first pivot axis 15, whereby the stacking end 17 of the conveyor may again be pivoted into a position suitable for delivery onto conveying means consecutively arranged in the road. The pivotability about the two axes 16 and 16' provides for the free space required for setting a center bolt.

Figure 2:
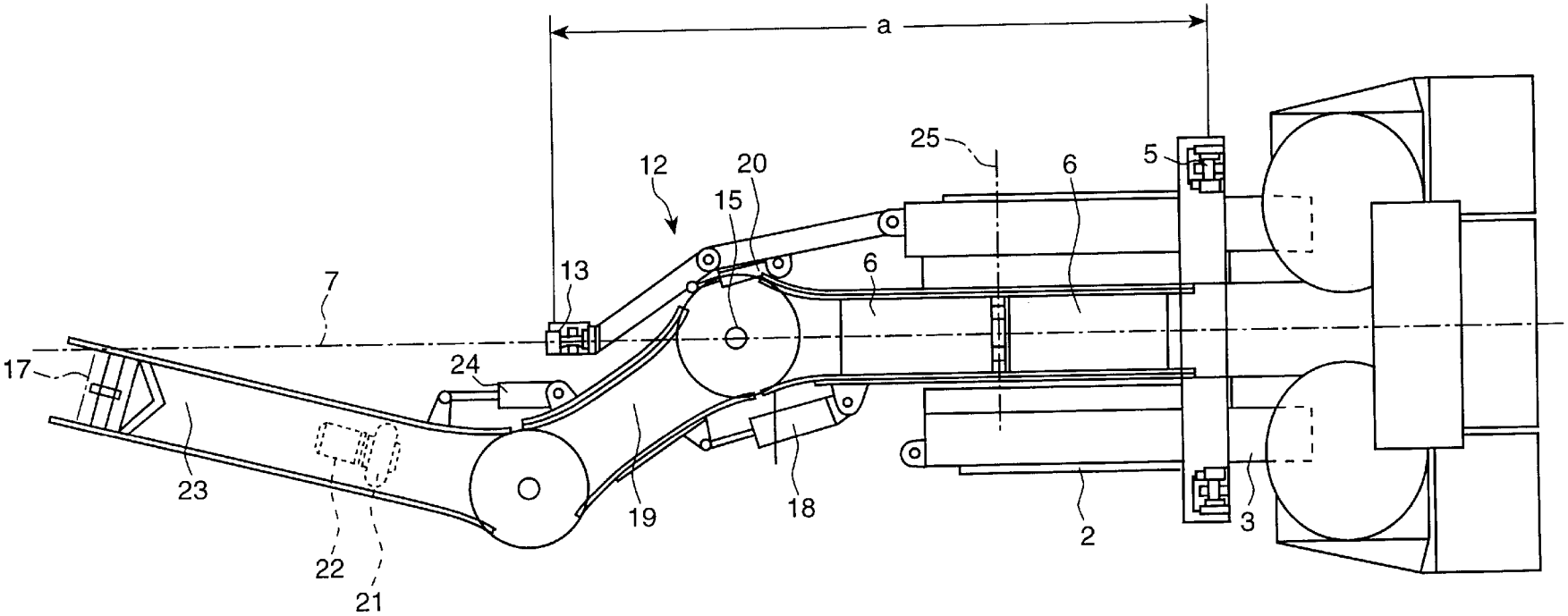
FIG. 2 is a modified embodiment of an apparatus according to FIG. 1 in another position of the cutting roll relative to the machine frame.

In the configuration according to FIG. 2, a cylinder 18 of a pivoting mechanism is additionally provided, by which the pivotable portion 19 of the conveyor 6 can be pivoted out laterally in order to clear the space necessary for the roof bolt drilling and setting apparatus 13. In addition, a hydraulic cylinder piston aggregate 20 for the pivoting mechanism of the articulated arms of the boom 12 is to be seen.

In order to render feasible the precise positioning of the delivery end 17 onto consecutively arranged roadway belt conveyors, a schematically indicated supporting wheel 21 may be employed, which may be connected with a driving mechanism 22. Alternatively, pivoting of the rear portion 23 of the conveyor 6 with a view to obtaining a suitable delivery position also may be effected via a hydraulic cylinder piston aggregate 24.

In the representation according to FIG. 2, the conveyor 6 has been displaced rearwardly relative to the machine frame 2 in the longitudinal direction of the machine, i.e., in the direction of the longitudinal axis 7 of the cutting machine with the cutting arm being extractable in the longitudinal direction of the cutting machine together with the roll for a cutting operation after appropriate anchoring of the roof bolt drilling and setting apparatus 5 and stationary positioning of the crawler 3, or machine frame 2, respectively. The distance between the roof bolts set by the roof bolt drilling and setting apparatus 5 from the center roof bolt set behind the cutting machine, as may be effected by the roof bolt drilling and setting apparatus 13, is schematically indicated by a and corresponds to an even-numbered multiple of the roof bolt row spacing, thereby rendering feasible precise operation over an extended period of time by stationarily positioning the base frame 2 of the cutting machine without affecting the mining work. Also with the conveyor 6 being displaced longitudinally, the configuration in terms of geometry is devised such that the articulated arm 12 for the roof bolt drilling and setting apparatus 13 will not be impeded.

Figure 3:
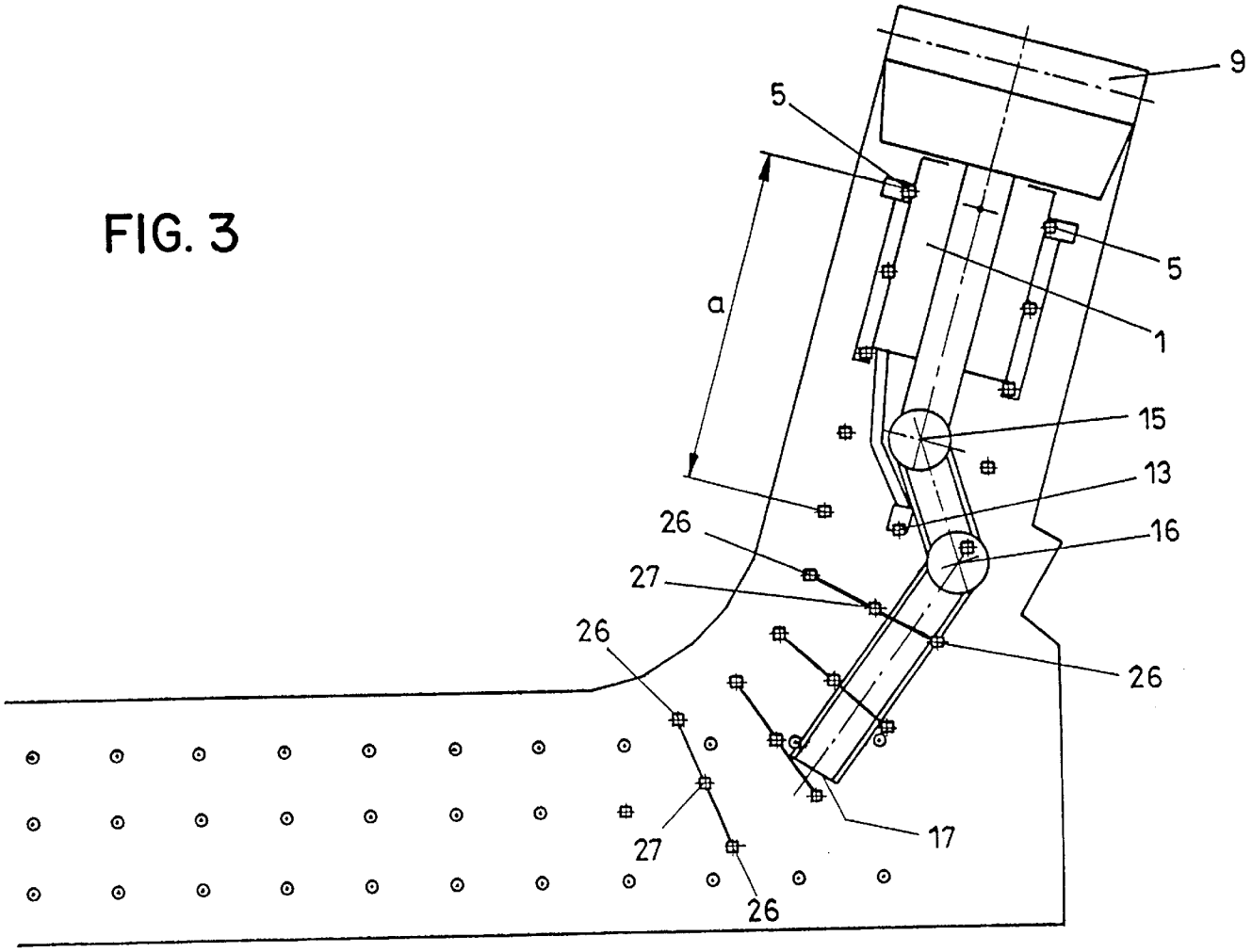
FIG. 3 is a top view on the roadway exhibiting a roof bolt pattern as may be obtained by the apparatus according to the invention.

From FIG. 3 a schematic pattern for the setting of roof bolts is apparent. The respective position of the roof bolt drilling and setting apparatus 5 and 13 enables a central roof bolt 27 to be each set between the externally arranged roof bolts 26 on the connection line between these two roof bolts, as is schematically illustrated in FIG. 3.

In FIGS. 4 and 5, the roof bolt drilling and setting apparatus 13 is in its operating position on the end of the articulated or pivot arm 12, which, being a telescopic arm, may be varied in terms of length by a cylinder piston aggregate not illustrated. By aid of a further cylinder piston aggregate 28, the pivot arm 12 may be lifted vertically about the revolute joint 29 of the bearing part 30 for vertically pivoting the pivot arm. Via this bearing part 30, the pivot arm 12 is hinged to the rear end of the machine frame 2 of the mining machine so as to be horizontally pivotable about the axis 11. In order to adjust the pivoted position of the roof bolt drilling and setting apparatus over a wide range, a simple horizontally acting revolute joint mechanism in the form of a strap 32 is mounted on the bearing part 30 so as to be rotatable about an axis 31 and, on its other end, communicates with the cylinder piston aggregate 34 via the revolute joint 33. The cylinder piston aggregate 34, in turn, on the machine frame of the mining machine is hinged to the axis 35, the desired pivot angle of the pivot arm being adjustable by displacement of the same in cooperation with the strap 32 and the bearing part 30. Further details as to the functional description are apparent from the top view on the roof bolt drilling and setting apparatus in FIG. 5, in which reference numerals have been uniformly retained. From that top view it is apparent how the displacement of the cylinder piston aggregate 34 via the strap 32 and the bearing part 30 brings about the adjustment of the pivot angle of the pivot arm 12 in the direction of arrow 36. The lateral attachment of the strap 32 to the bearing part 30 causes the curved strap 32 to embrace the axis 11 at the maximum piston stroke and largest pivot angle, the cylinder piston aggregate 34 forming an acute angle with the pivot arm 12 while embracing the pivot axis 11 via the strap 32. Due to such an arrangement, a large pivot angle range is obtained upon minimal displacement of the piston in counter-sense to the arrow, the strap 32 in that position registering with the extended longitudinal axis of the cylinder piston aggregate 34. For stabilizing the displacement paths, a supporting arm 37 is additionally apparent, one end of which is connected with the cylinder piston aggregate about the axis 33 and the other end of which is pivotable about the axis 38 on the rear part of the machine frame. Furthermore, FIG. 5 depicts the roof bolt drilling and setting apparatus 13 in its operating position with the pivot arm 12 being hinged centrally to the mining machine 2 and the roof bolt drilling and setting apparatus 13 being in an upright position so as to be secured against rotation about the rollover axis 39. The cylinder piston aggregate 40 serves to move the mounting 43 of the rollover and the roof bolt drilling and setting apparatus connected therewith from the operating position into a pivoted position according to FIG. 6 and FIG. 7, respectively, in the direction of arrow 41 about axis 42.

Figure 6:
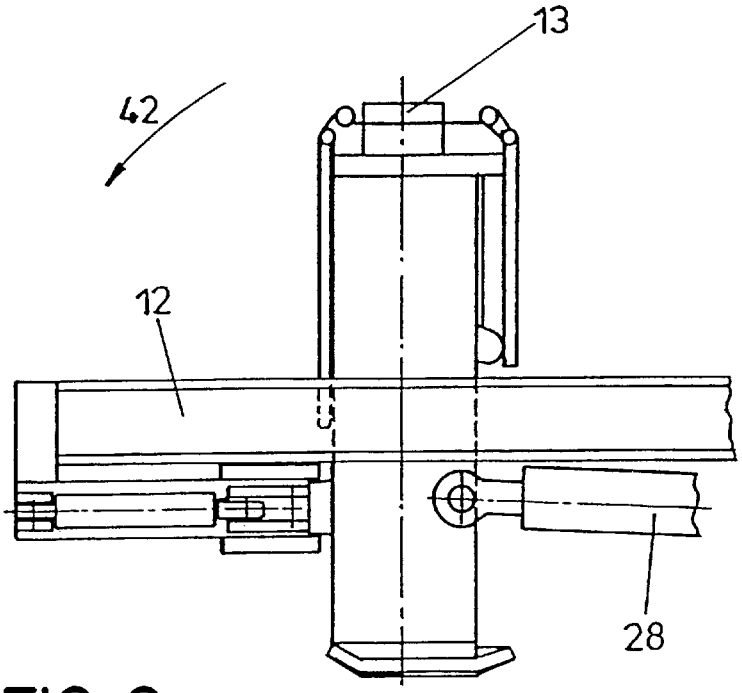
FIG. 6 illustrates the position assumed by the roof bolt drilling and setting apparatus for vertical pivoting, according to the perspective of FIG. 4.
Figure 7:
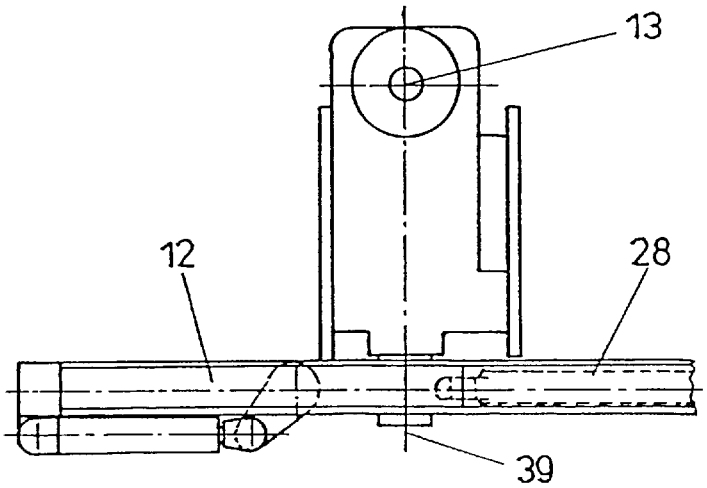
FIG. 7 is a top view on FIG. 6 according to the perspective of FIG. 5 for the situation represented in FIG. 6.

FIG. 7 illustrates how the rollover axis 39, on a bearing not illustrated in detail, is oriented transverse to the longitudinal axis of the pivot arm, then being in connection with the pivot arm 12 in the middle thereof and ready for vertically pivoting the roof bolt drilling and setting apparatus in the direction of arrow 42 according to FIG. 6.

We claim:

1. A roof bolt drilling and setting apparatus connected with a displaceable mining machine and movable relative thereto so as to be selectively positioned laterally with respect to the mining machine to extend beyond an outer side of the machine to permit said apparatus to be braced between a roof and a floor of a mine, wherein the mining machine is equipped with a conveyor having a discharging section positioned behind a travelling mechanism of the mining machine, and wherein the conveyor at a location adjacent a rear end of the mining machine is pivotable about a first pivot axis extending transverse to a longitudinal axis of the machine and about a second pivot axis spaced rearwardly of said first pivot axis and wherein said roof bolt drilling and setting apparatus is connected with the mining machine by a pivot arm joined to the rear end thereof, said pivot arm being pivotable so as to selectively move the roof bolt drilling and setting apparatus to a position located rearwardly of the mining machine in an extension of the longitudinal axis of the mining machine.

2. A roof bolt drilling and setting apparatus according to claim 1, wherein the pivot arm of the roof bolt drilling and setting apparatus is an articulated arm comprising two arms that are pivotable about parallel axes.

3. A roof bolt drilling and setting apparatus according to claim 2, wherein the articulated arm is dimensioned such that a longitudinal distance of bolt holes in a longitudinal direction of the machine relative to the roof bolt drilling and setting apparatus operating near a mine face corresponds to an even-numbered multiple of a longitudinal distance of neighboring holes outside the longitudinal axis of the machine.

4. A roof bolt drilling and setting apparatus according to claim 1 or 2, wherein the first and second pivot axes of the conveyor extend substantially parallel with each other.

5. A roof bolt drilling and setting apparatus according to claim 1 or 2, wherein the conveyor at an end portion carrying the first pivot axis is supported on the mining machine so as to be adjustable in height and pivotable about an axis substantially parallel with the floor.

6. A roof bolt drilling and setting apparatus according to claim 1 or 2, wherein a conveyor part oriented towards the discharging section on the second pivot axis carries a supporting wheel that is movable.

7. A roof bolt drilling and setting apparatus according to claim 6, wherein the discharging section of the conveyor is set in pivotal movement by a travelling mechanism of the supporting wheel.

8. A roof bolt drilling and setting apparatus according to claims 1 or 2, wherein a pivot angle of a conveyor portion located between the two pivot axes is rigidly fixed relative to the longitudinal axis of the machine during operation.

9. A roof bolt drilling and setting apparatus according to claim 2, wherein the pivotable arms of the articulated arm are telescopic arms.

10. A roof bolt drilling and setting apparatus according to claims 1 or 2, wherein the roof bolt drilling and setting apparatus is connected with the pivot arm so as to be pivotable into a horizontal position via a rollover.

11. A roof bolt drilling and setting apparatus according to claim 1 or 2, wherein a revolute joint mechanism hinged to one side of the pivot arm cooperates with a cylinder piston aggregate hinged to the rear end of the mining machine and that a pivot angle range of the pivot arm behind the mining machine amounts to approximately 180°.

12. A roof bolt drilling and setting apparatus according to claim 1 or 2, wherein the apparatus is pivotable on a rear end of the pivot arm about a vertical axis provided on a rollover.

13. A roof bolt drilling and setting apparatus according to claim 12, wherein the rollover in a starting position for vertical pivoting is supported on a bearing provided on the pivot arm.

14. A roof bolt drilling and setting apparatus according to claim 2, wherein at least one of the pivotable arms of the articulated arm is vertically pivotable via a hydraulic cylinder piston aggregate.

15. A roof bolt drilling and setting apparatus according to claim 1 or 2, wherein the pivot arm is hinged to the mining machine laterally of the longitudinal axis.

* * * * *